United States Patent [19]

Slysh

[11] 4,040,333

[45] Aug. 9, 1977

[54] ISOGRID SHELL GUN MOUNT

[75] Inventor: Paul Slysh, San Diego, Calif.

[73] Assignee: General Dynamics, Pomona, Calif.

[21] Appl. No.: 733,662

[22] Filed: Oct. 18, 1976

[51] Int. Cl.[2] ..... B64D 7/06

[52] U.S. Cl. ..... 89/37.5 R; 52/82; 248/183; 343/765

[58] Field of Search ..... 52/27, 80, 82, 630; 89/37, 37.5; 248/183; 343/765, 766, 912

[56] References Cited

U.S. PATENT DOCUMENTS 3,940,891 3/1976 Slysh ..... 52/82

*Primary Examiner*—Stephen C. Bentley

*Attorney, Agent, or Firm*—Neil F. Martin; Edward B. Johnson

[57] ABSTRACT

A gun mount is constructed of a plurality of alternately curved and flat isogrid plates arranged, annularly about and extending upward from a generally circular base, the plates being secured together to define a generally U-shaped shell-like structure having a pair of spaced apart upwardly extending trunnion support members, the grid structure of the flat plates consisting of an uniform unflanged isogrid structure which terminates at a pocketed transition section on three sides and a stiffened edge along the top, and the grid structure of the curved sections consisting of radial grid members which are intersected by curved diagonal grid members describing exponential spirals.

19 Claims, 11 Drawing Figures

ISOGRID SHELL GUN MOUNT

The invention herein described was made in the course of or under a contract or subcontract thereunder with the Department of the Navy.

BACKGROUND OF THE INVENTION

The present invention relates to support structures, and pertains particularly to light weight high strength gun mount and support structure.

Support structure, which also serves to house or enclose machinery and mechanisms, typically employ a complex frame of beams and girders covered by a sheet metal skin. The sheet metal skin may also be stressed and secured to the support frame in a manner to aid in the strength and rigidity of the overall structure. Such structures are generally satisfactory where strength to weight ratio is not of critical importance.

In many applications, such as military and aerospace, light weight, high strength support structures are critical. Gun mounts, for example, must have very high strength and rigidity in order to withstand the shock loads from recoil when the gun is fired. They must be able to provide high gun pointing accuracy and to create high response frequencies in the gun pointing control system. Such mounts must also be light weight and easily transportable.

It is also desirable that such structure be inexpensive and easy to manufacture. In this regard, it is desirable that the number of parts that must be secured together in fabricating the structure be minimized. A reduction in the length of seams or joints that must be welded also contributes to the ease and economy of construction.

When the gun mount structure also serves as a housing for control components for the gun, accessibility to such components is also an important consideration. The number, size, and location of access openings or doors can affect the strength and weight of the structure.

SUMMARY OF THE INVENTION

The primary object of the invention is to provide a shell-like support structure having maximum strength for a given weight.

Another object of the present invention is to provide a shell-like gun mount that is simple and inexpensive to construct and has a maximum strength for a given weight.

A further object of the present invention is to provide a shell-like gun mount that is simple and easy to construct and makes maximum use of isogrid construction techniques.

In accordance with the primary aspects of the present invention, a gun mount is constructed of a shell-like configuration utilizing a plurality of flat isogrid panels and a plurality of curved isogrid panels secured together and extending upward from an annular base.

BRIEF DESCRIPTION OF THE DRAWING

The above and other objects and advantages of the present invention will become apparent from the following description when read in conjunction with the accompanying drawing wherein.

DETAILED DESCRIPTION OF THE DRAWING

Figure 1:
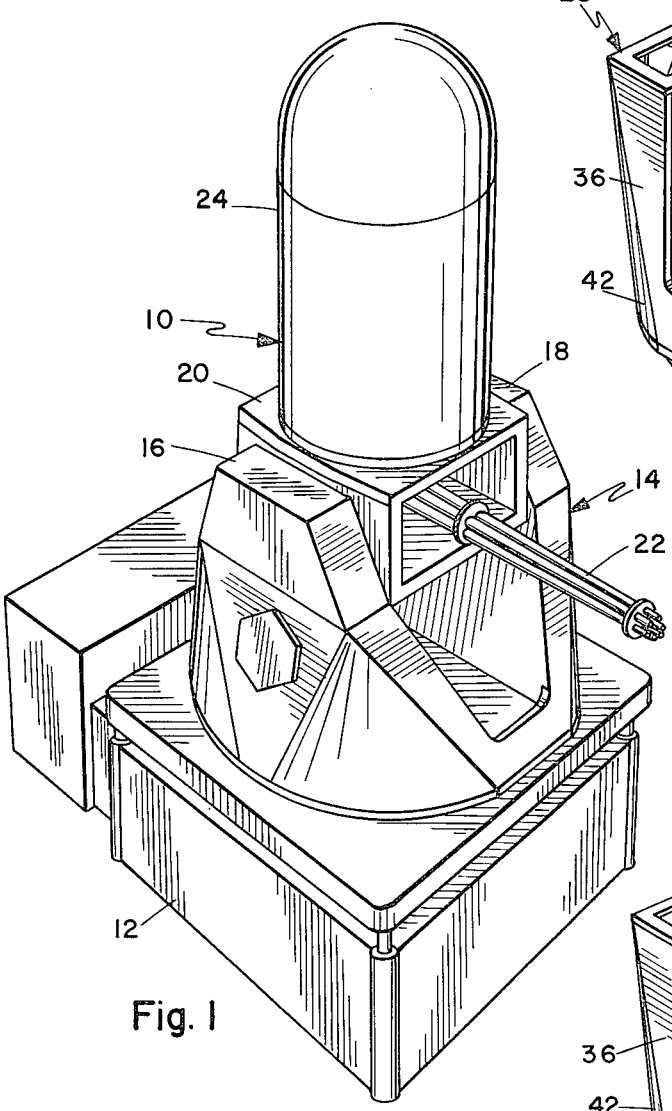
FIG. 1 is a perspective view of a weapon system incorporating the present invention.

Turning now specifically to FIG. 1 of the drawing, there is disclosed a weapon systems structure indicated generally by the numeral 10 which incorporates the present invention and comprises a mounting platform 12 on which is rotatably mounted a gun mount 14 for complete rotation about a vertical axis. The gun mount 14 is of a generally U-shaped configuration and includes spaced apart uprights which support trunnions 16 and 18 for mounting a gun mechanism 20 including one or more barrels 22. The gun is controlled by suitable radar means enclosed within a radar enclosure 24.

Figure 2:
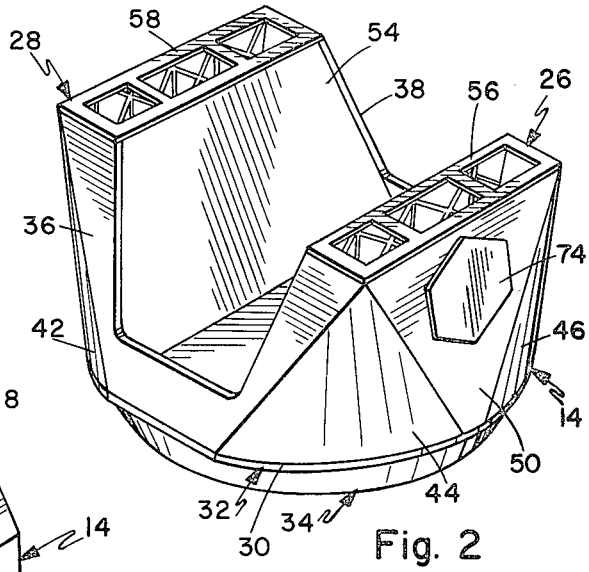
FIG. 2 is a perspective view of a gun mount in accordance with the present invention.
Figure 5:
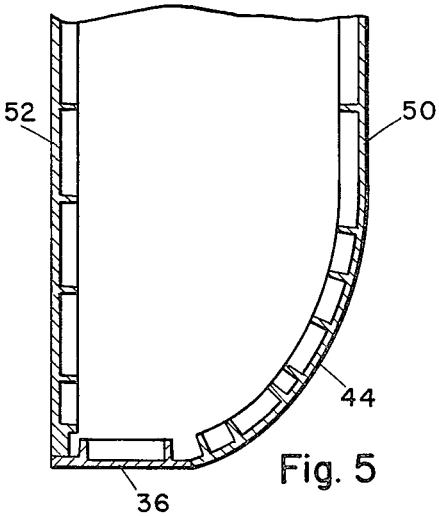
FIG. 5 is a sectional view taken generally along lines 5-5 of FIG. 4.
Figure 3:
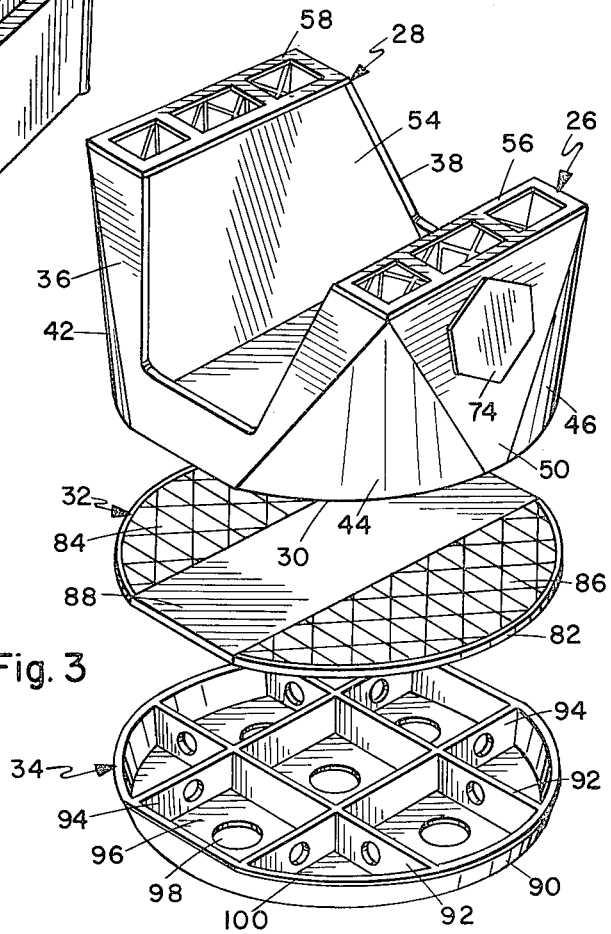
FIG. 3 is an exploded perspective view of the gun mount structure.
Figure 4:
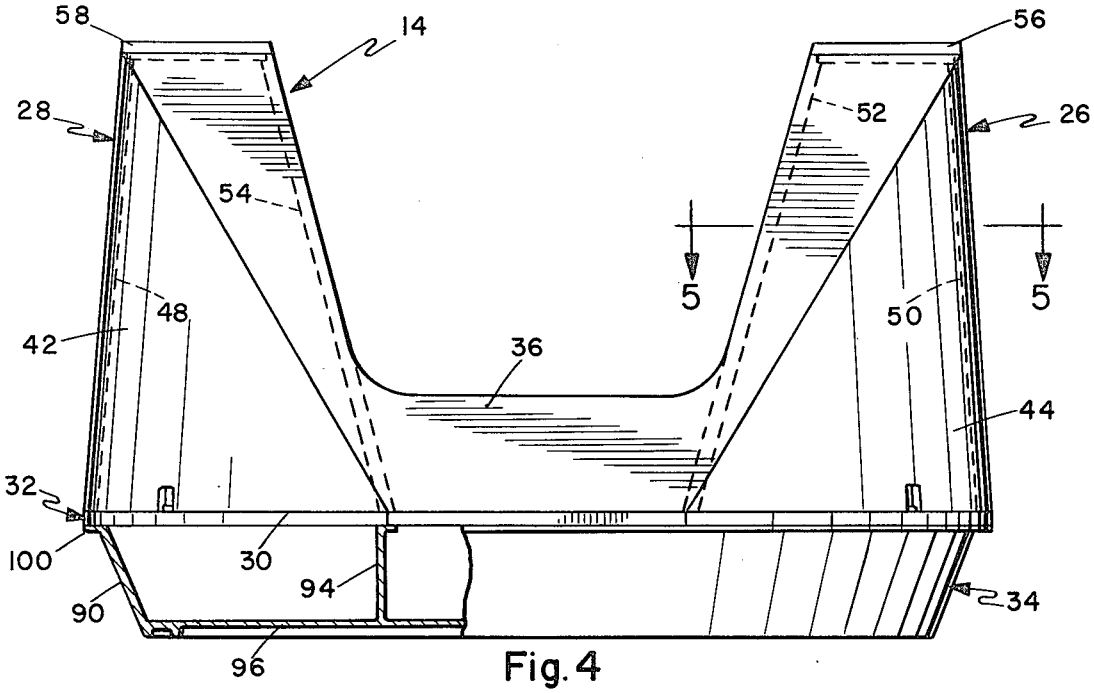
FIG. 4 is a front elevational view of the gun mount of FIG. 2.
Figure 6:
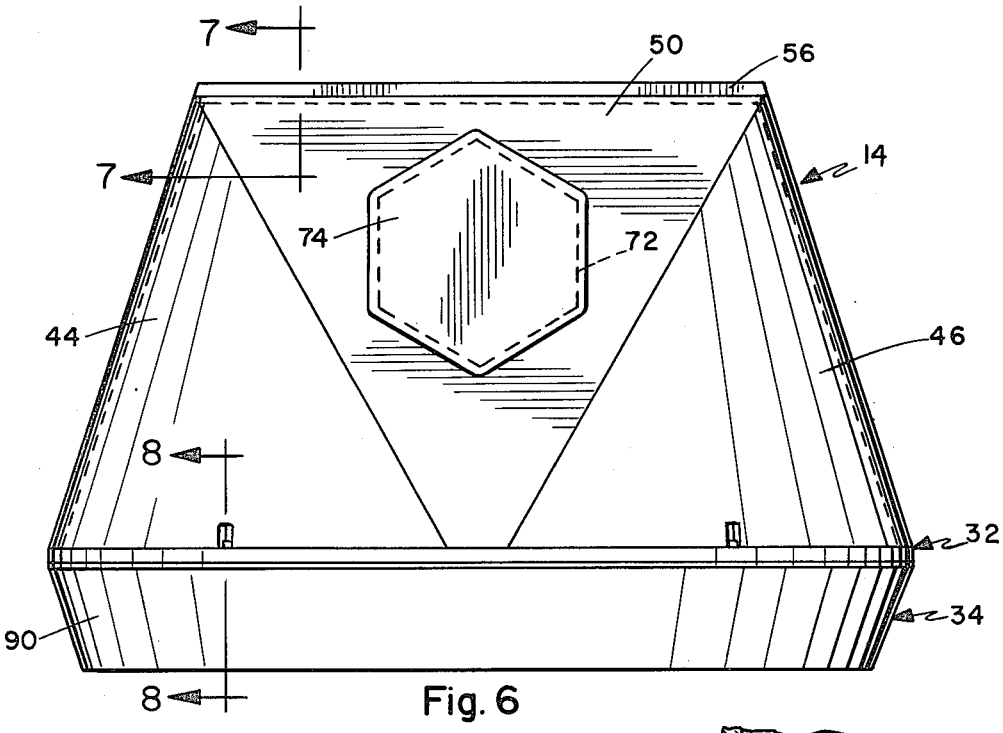
FIG. 6 is a side elevational view of the gun mount of FIG. 2.
Figure 7:
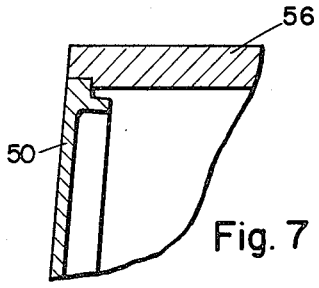
FIG. 7 is a sectional view taken along lines 7-7 of FIG. 6.
Figure 8:
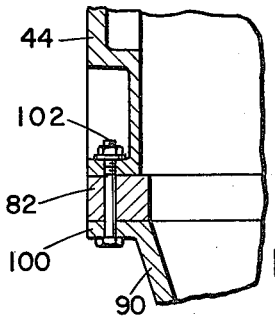
FIG. 8 is a sectional view taken along lines 8-8 of FIG. 6.

Turning now to FIGS. 2 and 3, the gun support of the present invention comprises a generally U-shaped structure having spaced apart upwardly extending shell-like trunnion support legs, which are hollow inside and serve as housing for elements and mechanisms as well as other components of the weapon system.

The shell-like structure of the gun mount is shaped and constructed to obtain the maximum strength and stiffness with a minimum amount of weight. To this end, the outer structure of the mount is constructed of a plurality of alternately curved and flat isogrid plates arranged angularly about and extending upward from a generally circular base 30 defined by the lower edges of the respective plates. The general shape of the respective legs or uprights 26 and 28 is somewhat like that of a pyramid beginning at a wider base at the bottom and converging to a narrower top or platform.

The shape of the plates forming the shell, as well as their isogrid structure, which will be more specifically defined later, contributes to the maximum strength to weight ratio of the present design. The plates or panels consist of two different flat panels and one different curved panel.

The exploded view of FIG. 3 best illustrates the three basic components of the overall gun mount, which consists of the upper shell structure detachably secured to an intermediate or isogrid midplate generally designated by the numeral 32 and a lower base member generally designated by the numeral 34. The plates 32 and 34 will be more fully discussed and described below.

The shell construction and the geometry of the plates from which the shell is constructed can be best understood by referring alternately to FIGS. 3 through 8. The upright legs or shells are made up of a plurality of plates including a pair of generally U-shaped flat end plates 36 and 38, generally forming the ends of the two upright legs and tying the two legs together. Secured to each side of the respective plates going in a counterclockwise direction comprises a plurality of generally triangular shaped curved plates 40, 42, 44 and 46. These curved plates are generally a triangular section from a cone. These curved plates are each connected together by a pair of inverted trapezoidal shaped flat plates 48 and 50. A pair of trapezoidal shaped inner flat plates 52 and 54 are connected between the two generally U-shaped flat plates 36 and 38. A pair of top plates 56 and 58 are secured at the upper ends of the legs defined by the upper edges of the plates.

It will be understood that these plates are all secured together along seams that extend at angles other than 90° to the base of the shell. It will also be noted that the outside surface of the shell is defined by alternate flat and curved plates extending upward from the angular base thereof and angularly around the circumference thereof. The geometric configurations of these plates together with the rigid structure thereof contributes to the strength and stiffness of the overall shell and transmits loads from the trunnion supports in a fairly uniform fashion to the ring bearing supporting the structure for rotation about a vertical axis.

Figure 10:
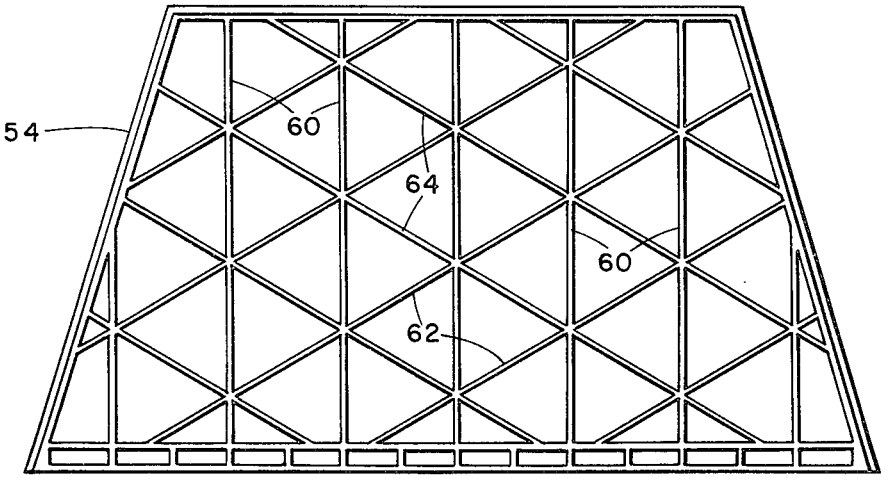
FIG. 10 is an inside view of an inner plate of the gun mount showing the grid structure.
Figure 11:
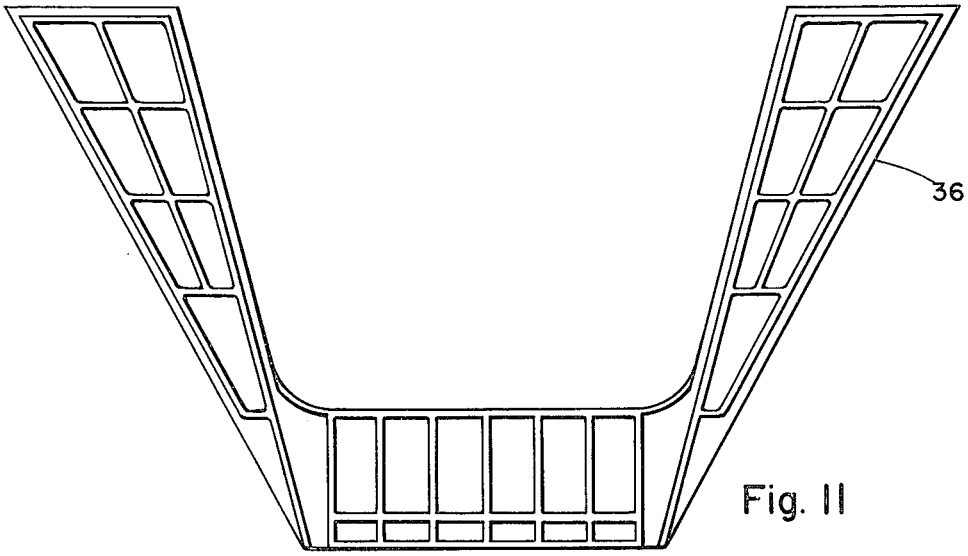
FIG. 11 is an inside view of an end plate of the gun mount showing the grid structure.

The isogrid pattern of the flat plates or panels can best be seen in FIG. 10 wherein the plate 54 is illustrated as having a grid pattern. This grid pattern is a uniform, unflanged, isogrid construction wherein a plurality of vertical flanges 60 are intersected by upwardly sloping flanges 62 and downwardly sloping flanges 64. These flanges all intersect at common points and at equal angles of 60°.

Figure 9:
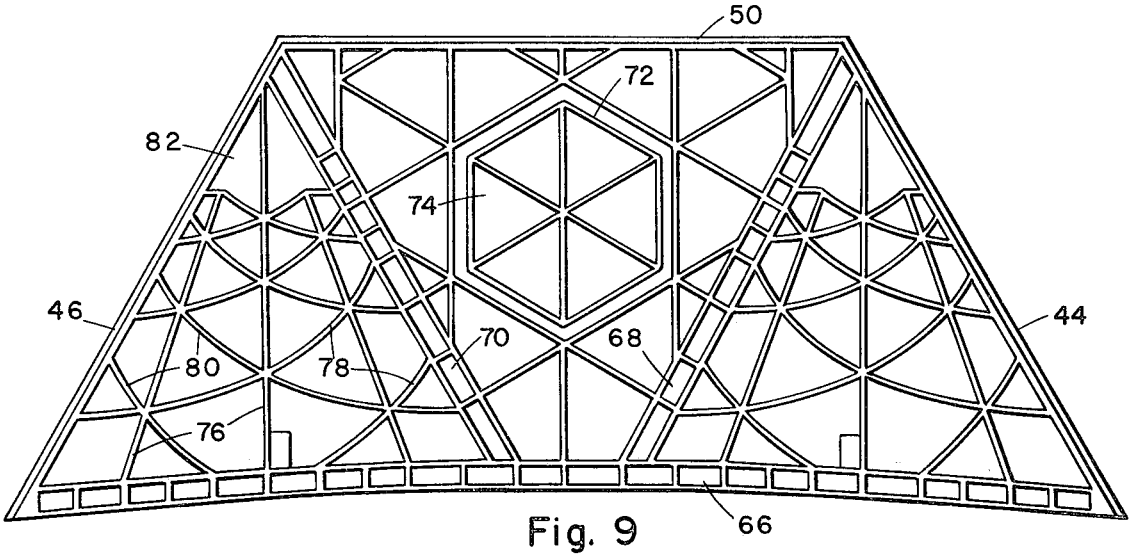
FIG. 9 is an inside view of one outer plate unit, shown flat to illustrate the grid structure.

The isogrid pattern of the plate 50 as shown in FIG. 9 refers to that previously described but terminating on three sides on a rectangularly pocket transition sections 66, 68 and 70. The plate 50 also includes an access hole 72 for providing access to the inside of the housing or shell and a cover plate 74 for covering the access opening. The grid pattern or geometry of the cover 74 continues that of the plate 50 and is in alignment therewith. The plate is preferably constructed to meet specifications without the existence of the door being placed thereon.

The curved plates 40, 42, 44 and 46 are identical and are triangular sections from a cone. The isogrid configuration of these curved sections is that used on a conical section. This grid structure comprises a plurality of ribs 76 extending from the base of the apex of the triangle with a plurality of curved diagonal grid members describing exponential spirals extending upward to the right as designated by the numeral 78 and upward to the left as designated by the numeral 80. These grid members intersect in a pattern such that equal angles of 60° exist between tangents to all grid center lines at points of intersection with no circles. This produces a uniform configuration and a reduction in local isogrid strength or grid member density as proportional to distances from the apex of the curved section. When the conical frustrum sections are formed, a mold line exists in the rectangularly pocketed transition between the flat and curved sections. These grid members 76 through 80 extend or project outward from the surface of a skin 82. The grid members may be either internally or externally of the shell structure but in the illustrated example, these grid members are on the inside of the shell walls to provide a smoother outer skin for the shell structure. The reinforcing grid work could be placed on the outside of the shell if desired.

The chosen isogrid patterns as used herein maximizes the uniformity with which trunnion loads are transferred to the ring bearing which supports the gun mount. The ring bearing supports the gun mount from beneath the base member 34. The pattern has been found to be the most easily produced.

The midplate 32 is constructed of a completely open grid assembly or isogrid structure throughout the major portion thereof. The open isogrid area extends beneath the open shells 26 and 28 and provides easy access of conduits and cables to that area. The closed isogrid area is provided in a center between the two upright shell members 26 and 28. The midplate consists of an outer angular ring 82 with a network of isogrid structure extending in the plane thereof and all intersecting identical angles are 60°. The alignment is such as to provide open isogrid areas 84 and 86 separated by center strip having a skin or cover 88 which may be made integral therewith or attached as a separate piece to the midplate.

The base member 34 consists of an annular frustroconical member 90 having a plurality of cross beams 92 and 94 extending across the rim and intersecting at right angles therein. A skin portion of a circular configuration 96 covers the bottom side of the base member 34 and includes a plurality of openings 98 to provide access to the inside thereof and the inside of the respective upright shells 26 and 28.

The member 90 includes a radially extending flange 100 to which a plurality of bolts 102 extend for securing the base member and midplate to the bottom of the support structure 14.

While the present invention has been illustrated and described by means of a specific embodiment, it is to be understood that numerous changes and modifications may be made therein without departing from the spirit and scope of the invention as defined in the appended claims.

Having described my invention, I now claim:

1. High strength load bearing shell structure comprising:

means defining a substantially circular base;

alternate flat and curved wall panels arranged circumferentially around and extending upwardly from said base;

said panels defining wall means converging inward from said base to the top and secured to plate means extending substantially parallel to said base;

said adjacent panels being secured together along lines that run at an angle to said base; and each of said panels having an outer skin structure and an inner isogrid structure.

2. The shell structure of claim 1 wherein:

the grid construction of at least one of said flat panels consists of an uniform unflanged isogrid structure which terminates at a pocketed transition section on three sides and a stiffened edge along the top.

3. The shell structure of claim 1 wherein:

the grid construction of said curved sections consists of radial grid members which are intersected by curved diagonal grid members describing exponential spirals.

4. The shell structure of claim 3 wherein:

said curved sections are sections of a frusto-conical shell.

5. The shell structure of claim 1 wherein:

said shell structure defines a substantially U-shaped trunnion support having laterally spaced upwardly extending shell-like support legs.

6. The shell structure of claim 1 wherein:

said base comprises a substantially circular edge defined by the lower edge of said shell structure.

7. The shell structure of claim 6 including:

a circular base plate detachably secured to said base of said shell, said base plate having a generally open isogrid construction.

8. The shell structure of claim 5 wherein:

said curved plates are triangular shaped portions of a conical shaped shell.

9. The shell structure of claim 2 wherein:

the grid construction of said curved sections consists of radial grid members which are intersected by curved diagonal grid members describing exponential spirals.

10. The shell structure of claim 9 wherein:

said curved sections are sections of a frusto-conical shell.

11. The shell structure of claim 10 wherein:

said shell structure defines a substantially U-shaped trunnion support having laterally spaced upwardly extending shell-like support legs defining housing means.

12. The shell structure of claim 11 wherein:

said base comprises a substantially circular edge defined by the lower edge of said shell structure.

13. The shell structure of claim 11 including:

a circular base plate detachably secured to said base of said shell, said base plate having a generally open isogrid construction providing open access to said housing means through said base plate from below.

14. The shell structure of claim 13 wherein:

said curved plates are triangular shaped portions of a conical shaped shell.

15. The shell structure of claim 5 wherein:

the grid construction of said curved sections consists of radial grid members which are intersected by curved diagonal grid members describing exponential spirals.

16. The shell structure of claim 15 wherein:

said curved sections are sections of a frusto-conical shell.

17. The shell structure of claim 3 wherein:

said shell structure defines a substantially U-shaped trunnion support having laterally spaced upwardly extending shell-like support legs defining housing means; and an access opening formed in a side of said housing means.

18. The shell structure of claim 17 including:

a circular base plate detachably secured to said base of said shell, said base plate having a generally open isogrid construction, providing open access to the interior of said housing means through said base plate from below.

19. The shell structure of claim 18 wherein:

said curved plates are triangular shaped portions of a conical shaped shell.

* * * * *